US008900372B2

(12) United States Patent
White

(10) Patent No.: US 8,900,372 B2
(45) Date of Patent: Dec. 2, 2014

(54) CRYOGENIC CLEANING METHODS FOR RECLAIMING AND REPROCESSING OILFIELD TOOLS

(71) Applicant: TRC Services, Inc., The Woodlands, TX (US)

(72) Inventor: Lonnie Dale White, Midland, TX (US)

(73) Assignee: TRC Services, Inc., The Woodlands, TX (US)

( * ) Notice: Subject to any disclaimer, the term of this patent is extended or adjusted under 35 U.S.C. 154(b) by 0 days.

(21) Appl. No.: 14/074,381

(22) Filed: Nov. 7, 2013

(65) Prior Publication Data

US 2014/0124003 A1 May 8, 2014

Related U.S. Application Data

(60) Provisional application No. 61/723,488, filed on Nov. 7, 2012.

(51) Int. Cl.
*B08B 7/02* (2006.01)
*E21B 37/00* (2006.01)

(52) U.S. Cl.
CPC ..... *E21B 37/00* (2013.01)
USPC ..... 134/17; 134/22.1; 134/22.11; 134/22.12; 134/22.18; 134/24; 134/30; 134/42; 451/36; 451/38; 451/40

(58) Field of Classification Search
CPC ..... B08B 9/00; B08B 9/02; B08B 9/027; B08B 9/021; B08B 9/053; B08B 9/08; B08B 9/0804; B24C 1/003; B24C 3/325; B24C 3/263; B24C 5/02; B24C 5/04
USPC ..... 451/36, 38, 40; 134/17, 22.1, 22.11, 134/22.12, 22.18, 24, 30, 42
See application file for complete search history.

(56) References Cited

U.S. PATENT DOCUMENTS

| | | | | | |
|---|---|---|---|---|---|
| 4,409,034 | A | * | 10/1983 | Williams | 134/4 |
| 4,491,484 | A | * | 1/1985 | Williams | 134/4 |
| 5,018,667 | A | | 5/1991 | Lloyd | |
| 5,160,548 | A | * | 11/1992 | Boisture | 134/7 |
| 5,294,261 | A | * | 3/1994 | McDermott et al. | 134/7 |
| 5,386,077 | A | * | 1/1995 | Cuthill et al. | 588/1 |
| 5,660,580 | A | | 8/1997 | Lehnig | |
| 5,885,133 | A | * | 3/1999 | Williams, Jr. | 451/40 |
| 6,214,130 | B1 | * | 4/2001 | Sasaki | 134/19 |

(Continued)

FOREIGN PATENT DOCUMENTS

JP 404145991 A * 5/1992

*Primary Examiner* — Bibi Carrillo
(74) *Attorney, Agent, or Firm* — Ramey & Browning, PLLC

(57) ABSTRACT

The disclosure relates to the cleaning of rods made of metal, particularly to the method of reclamation of used standard length rods, such as pump rods already used in the mechanical deep-pumping extraction of oil, as well as to the product made with the help of the mentioned method. The method of remanufacturing of standard length rods includes cleaning the rod with cryogenic liquids to eliminate environmental contamination and to assist in workplace safety.

12 Claims, 1 Drawing Sheet

(56) References Cited

U.S. PATENT DOCUMENTS

| | | | | |
|---|---|---|---|---|
| 6,315,639 | B1 * | 11/2001 | Kipp | 451/38 |
| 7,397,238 | B2 | 7/2008 | Walters et al. | |
| 8,187,057 | B2 | 5/2012 | Broecker | |
| 8,313,581 | B2 * | 11/2012 | Bear et al. | 134/22.1 |
| 2008/0176487 | A1 * | 7/2008 | Armstrong | 451/39 |
| 2008/0287040 | A1 * | 11/2008 | Kipp | 451/39 |
| 2014/0053404 | A1 * | 2/2014 | Johnson et al. | 29/888.021 |
| 2014/0124001 | A1 * | 5/2014 | White | 134/7 |

* cited by examiner

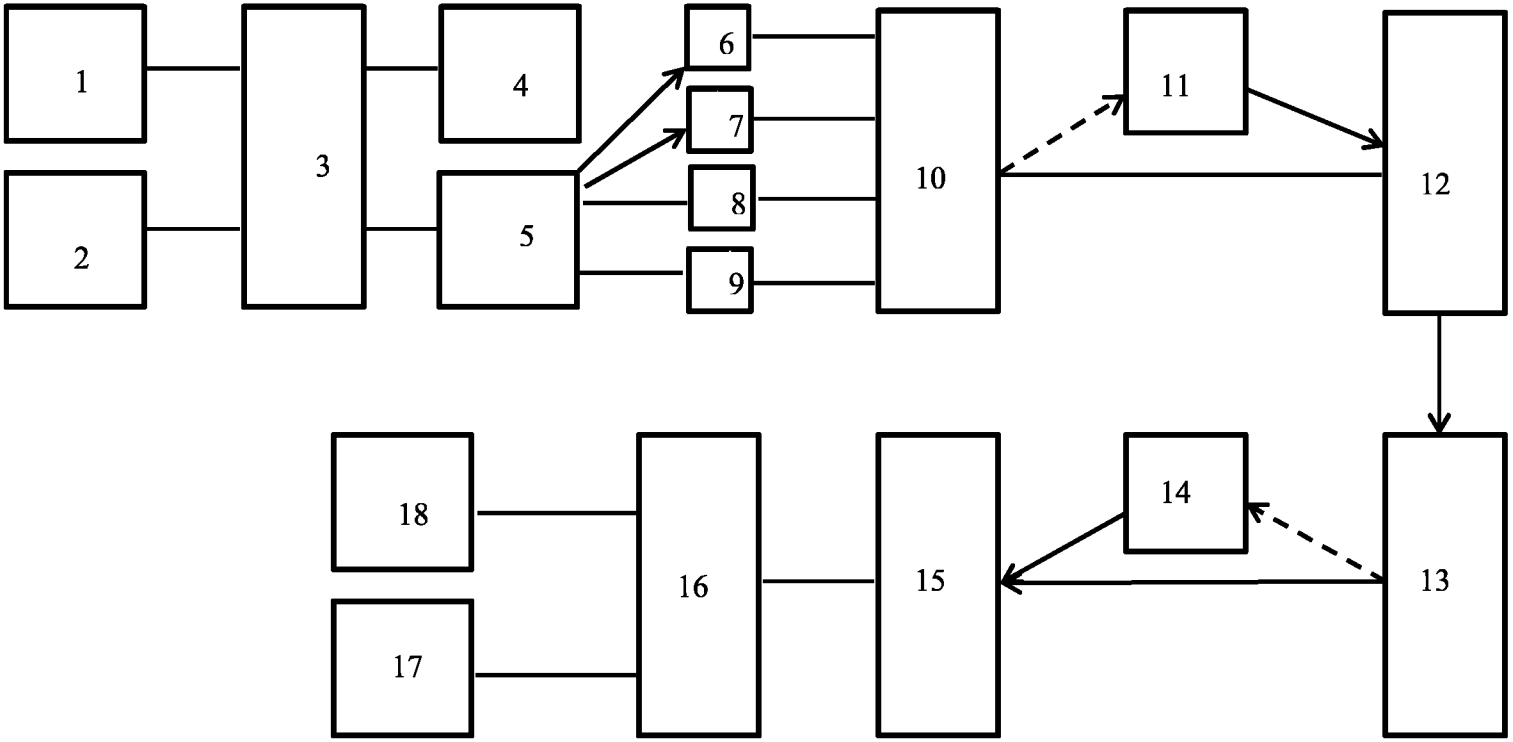
1
2
3
4
5
6
7
8
9
10
11
12
13
14
15
16
17
18

CRYOGENIC CLEANING METHODS FOR RECLAIMING AND REPROCESSING OILFIELD TOOLS

FIELD

The embodiments of the invention disclosed herein relate to the cleaning process in the recovery or remanufacturing of oilfield equipment. More specifically, the embodiments of the invention disclosed herein relate to the cryogenic cleaning of rods such as sucker rods and pony rods used in pump wells in oil fields.

BACKGROUND

A sucker rod is a rigid rod used in the oil industry to join together the surface and downhole components of a reciprocating piston pump installed in an oil well. These rods are typically between 25 and 30 feet (7 to 9 meters) in length, and threaded at both ends.

Certain methods of remanufacturing sucker rods for re-use comprise eliminating or reducing the fatigue stress in the used rods by a method involving thermally treating the rods at a temperature between about 200° C. and about 650° C. for 15 to 30 minutes. Typically this consists of normalization, upgrading or tempering, with reference to the material or rods remanufactured. After thermal treatment the rods are straightened while still hot to achieve the required straightness. Additionally, straightening while still hot allows for the removal of stress which can occur otherwise during the course of the straightening procedure.

Other methods used in the remanufacturing of rods such as sucker rods comprise the use of a device with two heads that have the ability to clamp two ends of the rod in need of treatment or modification. In this methodology, typically one head turns uncontrollably with the rod treated along its longitudinal central line. However, use of the aforementioned device can result in deformation of standard length sucker rods due to tension and torsion, even though cold working the rod's surface would improve the fatigue strength and the efficiency.

Typically the main process of reclaiming or reconditioning a used rod utilized in oil pump wells comprises obtaining the rod, cleaning the rod to remove contaminates from use in oil extraction, performing an inspection of the rod to determine if the rod should be reconditioned or discarded, categorizing the rod into steel class, heating the rod until plastic deformation, shaping the rod, cooling the rod and cutting the rod into the desired length. Embodiments of the invention pertain to a method for reconditioning a used sucker rod having a given diameter.

Typically, on pre-cleaned rods are found contaminates such as paraffin. Further, the cleaning process wherein contaminates are removed often comprises washing the rod with an organic compound. One organic compound typically used is kerosene. Other chemicals known in the art that are useful for cleaning rods are chemicals such as naptha and caustic acid. However, all of these aforementioned methods of cleaning leave toxic or caustic residue as a byproduct of the cleaning process.

Additionally, such cleaning agents can render chemicals attached to the rods soluble in organic compounds or in caustic acids. Such chemicals are often themselves toxic to the environment or pose cleanup problems at the cleaning facility.

It would therefore be advantageous to reduce the contamination to the environment and to the cleaning facility by the utilization of non-toxic cleaners and cleaners which do not result in solubility of contaminates from rods such as sucker rods. One such cleaning material is the use of non-toxic inorganic cryogenic liquids.

Because there is no secondary waste stream, non-toxic inorganic cryogenic liquids are advantageous from a cleaning standpoint. Typically, the only waste to clean up afterward is the grime, paraffin, rust or whatever contaminant was removed. Likewise, in the restoration applications total job time is greatly reduced due to the fact there is very little post-blast cleanup required.

Cryogenic liquid applications to the surface of sucker rods can produce an expansion factor upon making contact with the rods themselves. This is because the cryogenic liquids can change and expand from a liquid to a gas. Depending on the type of cryogenic liquid being used, and the air pressure and nozzle selected, the liquid can travel at speeds between 600 and 800 feet per second. Assuming the liquid is able to initially penetrate the contaminant, this expansion occurs at the underlying substrate, thus lifting the contaminant off. Alternatively or additively, the cryogenic liquid can produce a thermal shock effect, as the particles are at sub-zero temperatures.

Cryogenic liquids impacting a sucker rod or other pump rod surface with contaminants typically removes contaminates in one of three ways: via kinetic energy, via thermal shock or via a thermal-kinetic effect. Kinetic energy transfers the energy of the accelerated cryogenic liquid as it hits the surface of the rod to be cleaned during the blasting process; this is akin to a pressure washing effect. However, in some applications, a high pressure cryogenic liquid is not used. Likewise, thermal shock occurs when certain cryogenic liquids strike a much warmer contaminated surface during the blasting process. The cold temperature of the cryogenic liquid causes the bond between the surface being cleaned and the contaminants to weaken. This effect aids in the release of the contaminant when struck by the liquid during the blasting process. The thermal-kinetic effect combines the impact of evaporation and the rapid heat transfer discussed above. When the pressurized cryogenic liquid hits the contaminated surface, the vapor expands fast enough that micro-explosions occur which take off the contaminants from the rod.

In the embodiments herein discussed, the non-toxic inorganic cryogenic liquids are gasses which liquefy below the freezing point of water. Preferable examples of non-toxic liquids with an evaporation point below the freezing point of water which can be utilized in the present invention include: liquid nitrogen, liquid oxygen, liquid hydrogen, liquid helium, liquid neon, liquid argon, liquid krypton, liquid xenon, and the like.

SUMMARY OF THE INVENTION

Certain embodiments of the invention disclosed herein pertain to a method of cryogenic removal of contaminates from a sucker rod, the method comprising the steps of: 1) obtaining a sucker rod; and 2) delivering a cryogenic liquid to the surface of the sucker rod. In such embodiments, contaminants are removed from the used sucker rod by thermal shock that weakens the contaminants by dropping the temperature of the contaminants; by thermal-kinetic energy that causes vapor from evaporation to expand and causes micro explosions which remove the contaminants; or some combination thereof.

In further embodiments concerning the delivery of the cryogenic liquid, the delivery comprises bombarding the sucker rod with an inert cryogenic liquid which is a gas at 1 bar and at a temperature of 25° C. or greater. In specific embodiments, the cryogenic liquid is liquid nitrogen.

In further embodiments concerning the cryogenic liquid, the liquid is stored at a pressure greater than ambient pressure prior to being propelled under pressure through a nozzle to deliver the cryogenic liquid to the rod. In such embodiments, the cryogenic liquid is propelled from the nozzle at a pressure of about 80 psi to about 300 psi. In certain further embodiments, the liquid is delivered through a handheld nozzle. In other embodiments, the liquid is delivered through one or more nozzles in a fixed configuration. In other embodiments, one or more nozzles in a fixed configuration move relative to the rod and bombard the rod with the cryogenic liquid. In other embodiments, the one or more nozzles are in a fixed configuration and the rod moves relative to the nozzles.

In further embodiments concerning the removal of contaminants from a sucker rod, the method comprises collecting the contaminants in a receptacle and discarding them after removal from the rod.

After removal of contaminants, the methods, in certain embodiments, comprise performing a non-visual inspection of the used sucker rod to determine if the sucker rod is amenable to reconditioning.

After removal of contaminants, the methods, in certain embodiments, comprise categorizing the sucker rod into a steel class.

After removal of contaminants, the methods, in certain embodiments, comprise heating the rod until the rod is able to undergo plastic deformation and shaping the rod. In such embodiments, upon shaping, the rod has an increased length and the rod is cut into two rods. Further, upon shaping the rod, the rod has an increased length and the rod is cut into a shorter rod and a pony rod. Finally, in certain embodiments, after shaping the rod, the rod is subjected to shot peening.

BRIEF DESCRIPTION OF THE DRAWINGS

FIG. 1 is a flow chart of an embodiment of a method of reconditioning sucker rods, and wherein solid arrows are generally required and dashed arrows are optional.

DESCRIPTION

Introduction

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings making apparent to those skilled in the art how the several forms of the invention are embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

As used herein, the term "sorting" means to arrange according to class, kind, and/or size; to classify.

As used herein, the term "rod" includes hollow or solid rods, continuous rods or joints, and includes welded, flanged, screwed, and other rod goods. In particular, sucker rod joints are one type of rod which benefits from the methods described herein, but the disclosure is not so limited.

As used herein, the term "used rod" means a rod that has been in actual service for a purpose, such as transporting fluids, connecting a downhole pump to a surface driver, and the like, whether on the surface, downhole, underwater, onshore, or off-shore. In particular, in the case of sucker rods, used sucker rods are those that can be lifted to a holding area where they are uniquely identified according to size, quantity, company name and well location and tagged appropriately.

As used herein, the phrase "performing non-visual, non-destructive inspection" means a technique which does not impair the rods from performing their intended function or use, and does not involve a human visual test.

Embodiments

It is a goal of the present invention to remanufacture standard sized rods such as sucker rods by methods which include cleaning the sucker rod and reheating the rod body up to a particular temperature and applying pressure in conditions favorable for plastic deformation.

Still further, it is the goal of the present invention to devise new and environmentally friendly ways to clean the rod devices with little cleanup other than the debris from the dirty rods themselves.

In certain embodiments, following cleaning, it is a goal of the present invention to presort the rods, such as sucker rods, by grade and quality. Following assortment, the embodiments disclosed herein contemplate cleaning the rod devices.

Following cleaning, the embodiments disclosed herein contemplate the straightening of the rod devices.

Following straightening of the rod devices, the embodiments disclosed herein contemplate heating the rods to the point wherein plastic deformation can occur and pressure for shaping. Following the heating process, the methods disclosed herein contemplate subjecting the rod devices to a rolling mill. Following subjecting the rod devices to a rolling mill, the methods disclosed herein contemplate straightening the rods again if necessary.

Regarding the cleaning of rod devices, in certain embodiments, it is a goal to freeze the contaminants on the rod such that they fall off the rod into a contaminate catch area. Still further, in certain embodiments, it is a goal of the invention to freeze the contaminants on the rod such that the freezing causes expansion or contraction of the contaminants such that the expansion or contraction results in disassociation of the contaminants from the rod.

Further regarding the cleaning of rod devices, in certain embodiments regarding freezing the contaminates of the rod, it is a goal of the present invention that the cleaning medium is a cryogenic liquid which is a gas at room temperature such as liquid nitrogen, liquid oxygen, liquid hydrogen, liquid helium, liquid neon, liquid argon, liquid krypton, liquid xenon, and the like. Such cryogenic liquids are generally non-toxic to the environment or with respect to the Environmental Protection Agency of the United States.

In certain embodiments, the freezing agent, when used as a liquid to clean the rods, is a gas at 1 bar and 25° C. Preferable examples of cryogenic liquids which exist as gasses at 1 bar and 25° C. include liquid nitrogen, liquid oxygen, liquid hydrogen, liquid helium, liquid neon, liquid argon, liquid krypton, and liquid xenon.

The cryogenic liquid can either be manufactured with equipment on site or can be brought in from an outside source. For example, when liquid nitrogen is used, the liquid can be brought in from an outside source and stored in an insulated container until ready for use. Alternatively, the non-toxic cryogenic liquid is manufactured on site and typically entails the use of equipment that is capable of extracting a supply of cryogenic liquid from the atmosphere.

Typically, the cryogenic liquid is piped into the pressurized machine which will force the cryogenic liquid onto the surface to be cleaned. A specialized nozzle to direct the pattern of the cryogenic liquid is sometimes necessary to ensure coverage of the surface and with enough pressure to remove the residue and debris.

The cryogenic liquid blasting equipment in certain embodiments is directly connected to the cryogenic liquid extraction machine, or it can be a stand-alone unit. The cryogenic liquid blaster can be connected to an air compressor source that produces a range of pressures, typically from 6,000 to 55,000 psi to provide the energy to force the cryogenic liquid onto the surface of the sucker rod. The cryogenic liquid blaster is a piece of equipment that keeps the cryogenic liquid at a necessary temperature to remain in liquid form until it is fed into the hose that is attached to the rotating blast nozzle to provide the desired pattern and coverage of the blast stream to effectively remove the unwanted debris from the surface of the sucker rods.

In certain embodiments, the debris that is removed from the surface of the rods is captured into a receptacle that is disposed of according to regulatory requirements. The sucker rod coupling can remain attached to the rod through this cleaning process or can be removed prior to the commencement of the cleaning process. If the coupling remains attached to the sucker rod, the surface of the sucker rod is cleaned. Upon cleaning, the rod is ready for the inspection processes and remanufacturing process to begin. Typically, with the exception of condensation which can be controlled, there is no liquid or water produced.

The sucker rods are typically laid on a rack that feeds into a transfer conveyor. The visibly damaged rods are typically removed immediately. The remaining rods are typically fed onto the conveyor which typically conveys the rods into an area designed to accommodate the non-toxic cryogenic liquid blasting. The rods typically travel into the semi-enclosed cabinet with the non-toxic cryogenic liquid nozzles aligned to maximize the cleaning of the outer surface of the sucker rods. The rods can be conveyed thru the cleaning cabinet in single rod at time or can be multiple rods at a time. As the rods travel thru the cleaning cabinet, the non-toxic cryogenic liquid is propelled from the blasting machine through a hose to the rotating blast nozzles which typically direct the pattern to adequately clean the surface of the rods, the bare pin threads, and the coupling (if still attached). As the non-toxic cryogenic liquid enters into the crevices, cracks, etc. of the debris and residue, the non-toxic cryogenic liquid expands typically to between 100 and 1000 times its original size as it expands into a gas, thus removing the debris in the process.

The residue and debris on the outer surface of the rods, threads, and couplings are typically contained inside the cleaning cabinet to prevent the material from being scattered throughout the plant or area where the cleaning is being performed. A container is typically placed at the bottom of the cabinet to capture this debris for ease of disposal. The nozzles are typically directed in a manner so that the blast stream of air and non-toxic cryogenic liquid cleans the bare threads of the connecting threads, as well as the rod body and coupling body surfaces.

After this step in the cleaning process is completed, the rods are typically conveyed into the inspection plant. At this point the couplings, if attached to the rods, are removed. The coupling outer surface has typically been cleaned, and a lance with proprietary angles designed to deflect the non-toxic cryogenic liquid at an angle to clean the inside diameter of the couplings is used to complete the cleaning process for the couplings. Two more smaller cleaning cabinets are typically used to clean the pin connecting thread on each end of the sucker rod, that was enclosed inside the coupling, with the liquid nitrogen blasting equipment with same size pellets.

The sucker rod is then generally ready to enter the remainder of the inspection process. The coupling is cleaned on the outside and inside diameters and is ready for inspection process to commence.

In certain embodiments related to the removal of contaminates from the rods, it is an object of the invention that the contaminants are frozen and become brittle or expand, thus causing them to disassociate from the rods.

In certain other embodiments related to the removal of contaminants from the rods, it is an object of the invention that the cryogenic liquid involved in the cleaning of the rods is delivered to the rods at a high speed to wash off the contaminants through liquid pressure on the rods.

In certain further embodiments, it is an object of the invention to provide methods of recovery of the contaminants such that they are not deposited at the cleaning site or released into the environment. It is an object of the invention that a tray or trough be placed under the rod being cleaned in certain embodiments. It is another object of the invention that vacuum pressure be placed under the rod being cleaned.

In further embodiments, it is an object of the invention that the nozzle spraying the rod is capable of moving up and down the rod from end to end to spray cleaning agent on the rod. It is a further object of the invention that the nozzle spraying the rod is capable of moving in substantially a 360 degree rotation around the rod in order to spray the rod with the cryogenic liquid evenly.

Conversely, in other embodiments, it is an object of the invention that the rod is rotatable with respect to a stationary nozzle or a nozzle which does not rotate around the rod. In such embodiments, the rotatable rod is able to receive the cryogenic liquid evenly.

In further embodiments, it is an object of the invention that the rod is movable in an axial direction toward the ends of the rod. In some instances, this is perpendicular to the direction of the spray of the cryogenic liquid. In still further embodiments, it is an object of the invention that the rod is rotatable and also movable in an axial direction.

In still further embodiments, it is an object of the invention that a user holding a hand held nozzle will spray the cryogenic liquid onto the rod.

In still further embodiments regarding the nozzle, it is a further object of the invention that the cryogenic liquid delivery apparatus has multiple nozzles. In still further embodiments, it is a further object of the invention that wherein the cryogenic liquid delivery apparatus has multiple nozzles, the nozzles are within the same axis which is parallel to the rod. In other embodiments, the nozzles are in an axis which is perpendicular to the rod axis and surrounds or substantially surrounds the rod. In certain further embodiments, the nozzles are diagonal with respect to the rod axis and either surround or substantially surround the rod. In certain further embodiments, the nozzles are spaced randomly and are substantially perpendicular to the rod axis or in the alternative surround or at least partially surround the rod.

In embodiments concerning the nozzle shape, the nozzle can expand from the cryogenic liquid source such that the diameter or area of cryogenic liquid source hose is less than the diameter of the terminal end of the nozzle facing the rod.

In other embodiments concerning nozzle shape, the nozzle contracts from the cryogenic liquid source such that the diameter or area of the cryogenic liquid source hose, through which the cryogenic liquid flows before exiting into the nozzle, is greater than the diameter of the terminal end of the nozzle facing the rod. Still further, in other embodiments, the nozzle is the same size in diameter as the cryogenic liquid source hose.

In still other embodiments concerning nozzle shape, the terminal end of the nozzle facing the rod has multiple bores for the cleaning material to exit. In other embodiments, it is the object of the invention that the nozzle shape is such that there is an annular ring around the nozzle facing in an inward direction to focus the cleaning material to a certain point on the rod. Likewise, in other embodiments, it is the object of the invention that the nozzle shape is such that there is an annular ring around the nozzle facing in an outward direction to spread the cleaning material in an efficient manner to a large area of the rod to be cleaned.

Nozzles for use in cryogenic blasting are known in the art. Such nozzles can be found in U.S. Pat. Nos. 5,018,667; 5,660,580 and U.S. Pat. No. 8,187,057; each of which are specifically incorporated by reference in their entirety.

In embodiments concerning the application of the cryogenic liquid to the rod, the cryogenic liquid is pressurized such that it contacts the rod at a desired speed. The pressure can be any pressure contemplated that propels the cleaning material to the rod. In certain embodiments, the pressure is 10 psi, 20, psi, 30 psi, 40 psi, 50, psi, 60 psi, 70 psi, 80 psi, 90 psi, 100, 200, 300, 400, 500, 600, 700, 800, 900, 1000 or more psi.

In certain embodiments, the cryogenic liquids impacting a sucker rod or other pump rod surface with contaminants remove contaminates in one of three ways: via kinetic energy, via thermal shock or via a thermal-kinetic effect. In embodiments wherein the cryogenic liquid removes the contaminants via kinetic energy, the energy of the accelerated cryogenic liquid is transferred as it hits the surface of the rod to be cleaned during the blasting process; this is akin to a pressure washing effect. However, in some applications, a high pressure cryogenic liquid is not used. Likewise, thermal shock occurs when certain cryogenic liquids strike a much warmer contaminated surface during the blasting process. The cold temperature of the cryogenic liquid causes the bond between the surface being cleaned and the contaminants to weaken. This effect aids in the release of the contaminant when struck by the liquid during the blasting process. The thermal-kinetic effect combines the impact of evaporation and the rapid heat transfer discussed above. When the pressurized cryogenic liquid hits the contaminated surface, the vapor expands fast enough that micro-explosions occur which take off the contaminants from the rod.

Implementation

In implementation, rods are collected from petroleum producing sites and brought to a central location for inspection prior to any reconditioning or remanufacturing processes. Visual inspection is typically the first step in the convention reclamation and reconditioning processes.

Typically, the process of visual inspection typically involves a person visually locating pitting, corrosion, wear, stretched rods and bent rods. Any rod which fails to pass this visual inspection is removed from the aforementioned central location as rejected.

The sucker rods are typically laid on a rack that feeds into a transfer conveyor. The visibly damaged rods are typically removed immediately. The remaining rods are typically fed onto the conveyor which typically conveys the rods into an area designed to accommodate the cryogenic liquid blasting. The rods typically travel into the semi-enclosed cabinet with the cryogenic liquid nozzles aligned to maximize the cleaning of the outer surface of the sucker rods. The rods can be conveyed through the cleaning cabinet in single rod at time or can be multiple rods at a time. As the rods travel through the cleaning cabinet the cryogenic liquid is propelled from the blasting machine through a hose to the rotating blast nozzles which typically direct the pattern to adequately clean the surface of the rods, the bare pin threads, and the coupling (if still attached). As the cryogenic liquid enters into the crevices, cracks, etc. of the debris and residue, the cryogenic liquid expands typically to between 100 and 1000 times its original size as it expands into a gas, thus removing the debris in the process.

The residue and debris on the outer surface of the rods, threads, and couplings are typically contained inside the cleaning cabinet to prevent the material from being scattered throughout the plant or area where the cleaning is being performed. A container is typically placed at the bottom of the cabinet to capture this debris for ease of disposal. The nozzles are typically directed in manner so that the blast stream of air and cryogenic liquid cleans the bare threads of the connecting threads, as well as the rod body and coupling body surfaces.

After this step in the cleaning process is completed, the rods are typically conveyed into the inspection plant. At this point the couplings, if attached to the rods, are removed. The coupling outer surface has typically been cleaned, and a lance with proprietary angles designed to deflect the non-toxic cryogenic liquid at an angle to clean the inside diameter of the couplings is used to complete the cleaning process for the couplings. Two more smaller cleaning cabinets are typically used to clean the pin connecting thread on each end of the sucker rod that was enclosed inside the coupling with the cryogenic liquid blasting equipment.

The sucker rod is then generally ready to enter the remainder of the inspection process. The coupling is cleaned on the outside and inside diameters and is ready for inspection process to commence.

Inspection

Typically, the process of visual inspection typically involves a person visually locating pitting, corrosion, wear, stretched rods and bent rods. Any rod which fails to pass this visual inspection is removed from the aforementioned central location as rejected.

However, despite visual inspection, even clean rods can have unseen defects such as cracks that result in such rods being unacceptable for their intended use. Accordingly, sometimes other methods of inspection are used.

In many embodiments of the invention, the methods comprise performing non-visual or non-destructive inspection of used rods prior to any straightening as discussed below.

In order to inspect the rods in a non-visual manner, methods of the invention can include passing used rods through one or more stationary inspection stations. Alternatively, one or more inspection apparatus can be moved along stationary rods. Alternatively, both the used rods and inspection apparatus can move.

In certain embodiments of the invention pertaining to non-visual inspection, magnetic flux leakage inspection is used. Such methods typically involve the use of a magnetic coil and a detector assembly for inspecting the rods. Such systems typically employ one or more magnetic detectors adapted to be spaced a first distance from the rod member by one or more substantially frictionless members during an inspection. Methods specifically pertaining to magnetic flux leakage inspection are found in U.S. Pat. No. 7,397,238, which is herein incorporated by reference in its entirety. In alternative embodiments of the invention, other suitable non-visual, non-destructive inspections include, but are not limited to: ultrasonic inspection, eddy current inspection, acoustic emission inspection, and the like. Furthermore, the data from such tests can be presented in one or more formats, including visual format, such as on a CRT screen, flat panel screen, printer, strip chart recorder and the like.

Additionally, in addition to the detection of flaws, the rods, in certain embodiments, are separated into grades of steel. In such embodiments, it is beneficial to determine the grade of the steel rod before any treatment occurs so as to know the physical constraints and properties of the end product. In such embodiments, the grades of steel are typically divided into the following: Class C steel, Class D steel, Class KD steel, and High Strength steel. Within the classes, Class D steel is typically divided by alloy D and carbon D.

Straightening

Typically, in many embodiments of the invention, rods that have not been rejected, but that are bent or still possess rod guides are sent to a rod straightening machine and/or a rod guide removal machine. Typically, in many embodiments of the invention, once the rods have been straightened and no longer have rod guides, they are returned to the aforementioned central location.

Heating and Shaping

In certain embodiments of the invention, upon straightening of used rods, the rods are subjected to heating. In such embodiments, a rod such as a sucker rod in need of reclamation is heated to a temperature favorable for plastic deformation of the rod. In the case of steel, the temperature is generally within the range of about 900° C. to about 1300° C. This temperature range is known to be used for treating steel alloys through forging, rolling, deformation and the like. Still further in implementation, at the same time the rod is being heated to a temperature favorable for plastic deformation, a hot recrystallization of the rod takes place which eliminates inner stress of the rod that has accumulated during the course of the rod's operational life.

In certain embodiments, the desired geometry of the used rods is obtained by treatment under pressure. In such embodiments, the cross sectional area of the rod can be varied while the standard length of the rod is maintained. In such embodiments, mechanical properties of rods are enhanced during the pressure treatment such that a rod is structurally stronger in its peripheral zone. For example, by reheating the rod body up to a temperature which would allow it to undergo plastic deformation under pressure, the rod is structurally stronger in the peripheral zone as compared to rods treated by other methods of reclamation. Additionally, the high temperature used to make the rod favorable for plastic deformation also allows the rod to be reshaped to the correct geometric form as before without any defects caused in the operations such as cracks or cavities.

In further embodiments, reheating the rod is specifically achieved through the use of an induction furnace. As is known in the art, an induction furnace is an electrical furnace in which the heat is applied by induction heating of metal. The advantage of the induction furnace is a clean, energy-efficient and well-controllable melting process compared to most other means of metal melting. Since no arc or combustion is used, the temperature of the rod can be set such that it is no higher than what is required to make it amenable to plastic deformation; this can prevent loss of valuable alloying elements. Operating frequencies range from utility frequency (50 or 60 Hz) to 400 kHz or higher, usually depending on the material being melted, the capacity of the furnace and the melting speed required. Generally, the smaller the volume of the melts, the higher the frequency of the furnace used; this is due to the skin depth which is a measure of the distance an alternating current can penetrate beneath the surface of a conductor. For the same conductivity, the higher frequencies have a shallow skin depth, in other words, that is less penetration into the melt. Lower frequencies can generate stifling or turbulence in the metal.

In still further embodiments, upon heating the used rod to a temperature favorable for plastic deformation, the used rod can be treated under pressure, typically by radial-helical rolling. As a sucker rod or pump rod is an elongated bar shape, under pressure treatment the cross-sectional diameter of the rod will decrease such that the rod can be reformed into the next smaller standard size if desired. After plastic deformation, besides shrinking the cross-sectional area, the length of the rod will be increased if the mass of the metal remains constant or near constant. Typically, the reduction in diameter is one size down in terms of standard rod size. However, reduction by several sizes would allow two sucker rods to be produced out of one parent sucker rod. The standard sizes for sucker rods in English measurements are 1", ⅞", ¾", and ⅝".

As the heating and shaping increases the length, the rods can be cut before the heating and shaping to remove the ends, typically processed in one of two ways. In the first way, the rods simply have the ends cut off so that the rods are cut to the correct length and the remaining steel can be used to make pony rods. Alternatively, the ends can be cut off plus additional footage in the body of the rod in order to produce new bar stock that is the length needed to produce a new sucker rod.

After treatment via plastic deformation, the rods, such as sucker rods can be raw bar stock that can be sold to users or other manufacturers in the petroleum industry. These rods can be made to a standardized length again by cold chiseling, abrasive cutting or both.

In this embodiment, the users or other manufacturers can forge the ends of the sucker rods to fit their particular equipment needs.

Shot Peening

Upon reformation, the rod is then cooled and stored for use or further treatments.

In certain embodiments, after cooling the rod, such as a sucker rod, the rod is subjected to shot peening. Shot peening is a cold working process in which the surface is bombarded with small spherical media called shot. As each individual shot particle strikes the surface, it produces a slight rounded depression. Plastic flow and radial stretching of the surface metal occur at the instant of contact and the edges of the depression rise slightly above the original surface. Benefits obtained by shot peening are the result of the effect of the compressive stress and the cold working induced. Compressive stresses are beneficial in increasing resistance to fatigue failures, corrosion fatigue, stress corrosion cracking, and hydrogen assisted cracking. Shot peening is effective in reducing sucker rod fatigue failures caused by cyclic loading. Stress corrosion cracking cannot occur in an area of compressive stress. The compressive stresses induced by shot peening can effectively overcome the surface tensile stresses that cause stress corrosion. Shot peening has been shown to be effective in retarding the migration of hydrogen through metal. Shot peening improves the surface integrity of the sucker rod. As peening cold-works the rod surface, it blends small surface imperfections and effectively eliminates them as stress concentration points.

Final Inspection

In certain embodiments of the invention, following the sorting, cleaning, straightening, heating and shaping of the rods, the rods are subject to a final inspection. Typically such inspection is eddy current inspection. Eddy current inspection uses electromagnetic induction to detect flaws in conductive materials. In a standard eddy current inspection a circular coil carrying current is placed in proximity to the sucker rod. The alternating current in the coil generates changing magnetic field which interacts with sucker rod and generates an eddy current. Variations in the phase and magnitude of these eddy currents can be monitored using a second receiver coil, or by measuring changes to the current flowing in the primary coil. Variations in the electrical conductivity or magnetic permeability of the test object, or the presence of any flaws, will cause a change in eddy current and a corresponding change in the phase and amplitude of the measured current.

Summary of Implementation

In implementation of the aforementioned embodiments and methods, and referring to FIG. 1, rods, hereinafter for simplicity referred to as sucker rods, are collected from upstream petroleum producing sites via a collection process 1. Alternatively, the sucker rods are shipped to a common location via a shipment process 2. The sucker rods are then subjected to presortment 3. First, the sucker rods are scanned through non-visual magnetic flux leakage inspection to sort out flaws in the sucker rods. Sucker rods which have failed inspection are subject to a discarding process 4. Sucker rods which have not failed this inspection are subjected to a grade sortment procedure 5 to sort out the grade of steel, such as C 6, D 7, KD 8 and High Strength 9. Sucker rods which have not failed inspection due to extensive cracks or extensive corrosion, and have been sorted are then subjected to a cleaning procedure 10.

In a preferred implementation, the sucker rods, separated by grade of steel, are taken to a plant. Each grade of sucker rods is treated in turn. In the plant, the sucker rods are first cleaned.

After cleaning, each sucker rod in need of straightening is subjected to a rod straightening machine 11. After straightening, the rods are capable of being heated and shaped.

In the step of heating and shaping, each rod is placed upon a conveyor which transports each sucker rod through an induction furnace 12 or a series of induction furnaces with a temperature of between about 900° C. to about 1300° C. The heating is designed not to melt the sucker rod but to soften each sucker rod to the point wherein plastic deformation is possible.

Following heating to the point wherein plastic deformation is possible, the sucker rod is subjected to a pressure machine 13 in order to smooth out any surface imperfections. This process compresses the sucker rod such that the cross sectional area is changed.

Upon shaping, the conveyor removes the sucker rod from the pressure machine and the sucker rod is allowed to cool. After cooling, the sucker rod is optionally subjected to shot peening 14. Regardless of whether the sucker rod is subjected to shot peening, the sucker rod is optionally cut to a desired length through a cutting procedure 15. When cut to a desired length, the sucker rod is then subjected to a final inspection process 16. Generally, the inspection process is eddy current inspection. After inspection, the sucker rod is shipped to an outside manufacturer 17 in order to forge end pieces on the sucker rod for appropriate applications. Optionally, factory forging 18 is done wherein the forging is done at the same location as where the rod is heated and shaped.

It should be appreciated by those of skill in the art that the techniques disclosed in the aforementioned embodiments represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit or scope of the invention.

The invention claimed is:

1. A method of cryogenic removal of contaminants from a sucker rod, the method comprising the steps of:

a) obtaining a sucker rod with contaminants;

b) removing said contaminants from the sucker rod by delivering a cryogenic liquid to a surface of the sucker rod, the cryogenic liquid selected from a group consisting of: liquid nitrogen, liquid oxygen, liquid hydrogen, liquid helium, liquid neon, liquid argon, liquid krypton and liquid xenon, wherein said contaminants are removed from the sucker rod by:

i) thermal shock that weakens the contaminants by dropping a temperature of the contaminants; or ii) thermal-kinetic energy that causes vapor to form from evaporation of the cryogenic liquid, wherein the vapor expands and causes micro explosions which remove the contaminants; or iii) combinations thereof;

c) heating the sucker rod until the rod is able to undergo plastic deformation;

d) shaping the sucker rod; and e) after step d), subjecting the sucker rod to shot peening.

2. The method of claim 1, wherein the cryogenic liquid is liquid nitrogen.

3. The method of claim 1, wherein the cryogenic liquid is stored at a pressure greater than ambient pressure prior to being propelled under pressure through a nozzle to deliver the cryogenic liquid to the rod.

4. The method of claim 1, wherein after the contaminants are removed, the contaminants are collected in a receptacle and discarded.

5. The method of claim 1, wherein delivering the cryogenic liquid comprises delivering the liquid through a handheld nozzle.

6. The method of claim 1, wherein delivering cryogenic liquid comprises delivering the cryogenic liquid through one or more nozzles in a fixed configuration.

7. The method of claim 1, further comprising performing a non-visual inspection of the sucker rod to determine if the sucker rod is amenable to reconditioning.

8. The method of claim 1, wherein upon shaping the rod, the rod has an increased length and the rod is cut into two rods.

9. The method of claim 1, wherein upon shaping the rod, the rod has an increased length and the rod is cut into a shorter rod and a pony rod.

10. The method of claim 3, wherein the cryogenic liquid is propelled from the nozzle at a pressure of about 80 psi to about 300 psi.

11. The method of claim 6, wherein the one or more nozzles in a fixed configuration move relative to the rod and bombard the rod with the cryogenic liquid.

12. The method of claim 6, wherein the one or more nozzles are in a fixed configuration and the rod moves relative to the one or more nozzles.

* * * * *